US006079706A

United States Patent [19]

Hashem

[11] Patent Number: 6,079,706

[45] Date of Patent: Jun. 27, 2000

[54] PASSIVE LEAD-IN FOR PAPER STACK INTO STAPLER

[75] Inventor: Michael P. Hashem, Mississauga, Canada

[73] Assignee: Xerox Corporation, Stamford, Conn.

[21] Appl. No.: 09/026,820

[22] Filed: Feb. 20, 1998

Related U.S. Application Data

[60] Provisional application No. 60/053,251, Jul. 21, 1997.

[51] Int. Cl.[7] ..... B65H 39/02

[52] U.S. Cl. ..... 270/58.08; 270/58.12; 399/410

[58] Field of Search ..... 270/58.08, 58.15, 270/58.09, 58.12; 399/410; 227/39, 50, 150; 414/790.3

[56] References Cited

U.S. PATENT DOCUMENTS

| | | | |
|---|---|---|---|
| 4,901,994 | 2/1990 | Ishiguro et al. | 270/53 |
| 4,905,055 | 2/1990 | Higaki | 270/58.08 X |
| 4,994,865 | 2/1991 | Nishimori et al. | 355/324 |
| 5,012,297 | 4/1991 | Yamashita et al. | 355/321 |
| 5,036,357 | 7/1991 | Nishimori et al. | 355/202 |
| 5,053,831 | 10/1991 | Ishiguro et al. | 270/58.15 X |
| 5,229,812 | 7/1993 | Toyama et al. | 270/58.08 X |
| 5,289,250 | 2/1994 | Hiroi et al. | 355/311 |
| 5,382,011 | 1/1995 | Tani | 270/37 |
| 5,508,798 | 4/1996 | Yamada | 270/58.09 X |
| 5,653,573 | 8/1997 | Aoki et al. | 271/287 X |
| 5,778,300 | 7/1998 | Murakami et al. | 271/287 X |

*Primary Examiner*—Christopher P. Ellis
*Assistant Examiner*—Patrick Mackey
*Attorney, Agent, or Firm*—Andrew D. Ryan

[57] ABSTRACT

A device for guiding a plurality of sheets moving in a direction along a path toward a finishing device attachable to a printing machine is provided. The device includes a first member having a first member surface thereof and a second member having a second member surface thereof. The first member surface and the second member surface define a guide for directing the sheets therebetween toward the finishing device. At least a portion of at least one of the first member surface and the second member surface converge toward the other of the first member surface and the second member in the direction of the path and in a direction perpendicular to the path and toward the proximate end of the sheets.

24 Claims, 8 Drawing Sheets

PASSIVE LEAD-IN FOR PAPER STACK INTO STAPLER

This application is based on a provisional application No. 60/053,251, filed Jul. 21, 1997.

This invention relates generally to a stapler for a printing machine, and more particularly concerns a paper guide for a stapler for a printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

The output from copy machines and printers in the form of printed copy sheets frequently are grouped together in sets. Often, these sets need to be fastened together. Stapling is one of the typical ways of adjoining a set of copy sheets. Feeding a set of copy sheets into a stapler is fraught with a number of problems. Typically, the copy sheets curl either upwardly or downwardly. Particularly, the top and bottom sheets tend to curl or frequently, the entire set may curl together. An upward curl is somewhat more frequent to occur than a downward curl and is also more difficult to correctly staple properly. When the sheets are positioned over a stapler, often at least some of the sheets may be bent back and thus the set will not be properly stapled.

When, as is often the case, the set is stapled automatically as part of a finishing operation in a finisher attached to the copy machine, the set must be automatically be fed toward a stapler or a stapler fed toward a gathered set of sheets. To assure that the sheets are gathered together and to avoid the inadvertent stapling of a finger, the stapler includes a guide with a spaced apart difference small enough to avoid the entry of a finger. Sheets when fed between these guides typically curl backwards and prevent proper stapling.

Attempts have been made to overcome this problem. In one system, spring loaded fingers hold a set of sheets and the spring loaded fingers are operated by a solenoid. The set of preclamped sheets are then fed toward the stapler and later after stapling, released. This set requires an expensive solenoid, an expensive set of spring loaded fingers, and a complicated mechanism to move the spring loaded set of sheets in and out of the stapler.

The aforementioned alternative is very expensive and therefore often the sheets are gathered together and clamped in a fixed position and a movable stapler is positioned over the sheets, staples the sheets, and then returns to a retracted position. This stapling apparatus is also expensive in that a clamping device is needed for the set of sheets and a mechanism for translating the stapler is also required.

The following disclosures may be relevant to various aspects of the present invention:

- U.S. Pat. No. 5,382,011 Inventor: Tani Issue Date: Jan. 17, 1995
- U.S. Pat. No. 5,289,250 Inventor: Hiroi et al. Issue Date: Feb. 22, 1994
- U.S. Pat. No. 5,036,357 Inventor: Nishimori et al. Issue Date: Jul. 30,1991
- U.S. Pat. No. 5,012,297 Inventor: Yamashita et al. Issue Date: Apr. 30, 1991
- U.S. Pat. No. 4,994,865 Inventor: Nishimori et al Issue Date: Feb. 19, 1991
- U.S. Pat. No. 4,901,994 Inventor: Ishiguro et al. Issue Date: Feb. 20, 1990

The relevant portions of the foregoing disclosures may be briefly summarized as follows:

- U.S. Pat. No. 5,382,011 discloses a recording device including a stapler. The stapler is capable of binding a stack of sheets In either of an edge bind mode or a center bind mode. Sheets are stacked in the same position for both modes. In the edge bind mode the sheets are bound where they are stacked, while in the center bind mode they are bound after being moved a predetermined position.
- U.S. Pat. No. 5,289,250 discloses a sheet post processing device in the form of a stapler including trays for accommodating the sheets. The device includes an aligning device for aligning the sheets on the trays by urging edges of the sheets. The stacked sheets are moved through an upper guide and a lower paper guide. An aligning rod urges the stacked sheets in order to improve alignment.
- U.S. Pat. No. 5,036,357 discloses a copying apparatus including a stapling function. A guide roller is rotatably mounted at the lower portion of a lever pivotably fixed to the guide plate to prevent the leading end of the accommodated bunch of copy paper sheets from swelling. The guide plate is provided with regulating levers and a charge eliminating brush.
- U.S. Pat. No. 5,012,297 discloses a copy machine having a stapler incorporated therewith. The stapler is a conventional electric type. A receiver is disposed on the plane common to the stopper and staples a corner of the bundle of sheets. A guide roller rotates and is fixed to the bottom of a lever which shakes from a guide plate. This roller prevents the leading edges of the sheets from bulging.
- U.S. Pat. No. 4,994,865 discloses an electric powered stapler for use with a copy machine. A staple receiving stand is arrange on the same plane as the stopper and the corner of the bunch of sheets is adjusted and accommodated in the staple tray. The stapler includes a guide roller which is rotatably mounted at the lower portion of a lever pivotably fixed to the guide plate to prevent the leading end of the bunch of copy paper sheets from swelling.
- U.S. Pat. No. 4,901,994 discloses an electric powered stapling unit for use with a copy machine. The stapling unit includes a tray, a motor, side guide plates, a stopper and a stapler. The tray is oscillatably installed and the tray is vibrated. The vibration assist to align the sheets. The sheets transported onto the tray are trued up by the side plates and the stopper as the tray is vibrated.

In accordance with one aspect of the present invention, there is provided a device for guiding a plurality of sheets moving in a direction along a path toward a finishing device attachable to a printing machine. The device includes a first member having a first member surface thereof and a second member having a second member surface thereof. The first member surface and the second member surface define a guide for directing the sheets therebetween toward the finishing device. At least a portion of at least one of the first member surface and the second member surface converge toward the other of the first member surface and the second member in the direction of the path and in a direction perpendicular to the path and toward the proximate end of the sheets.

Pursuant to another aspect of the present invention, there is provided a stapling device for affixing a set of sheets moving in a direction along a path toward a stapling station. The stapling device includes a housing, a stapler secured to the housing and positioned at the stapling station, and a guide. The guide is secured to the housing. The guide includes a first member having a first member surface thereof and a second member having a second member surface thereof. The guide further defines an aperture between the first member and the second member. The first member surface and the second member surface direct the sheets therebetween through the aperture toward the stapler. At least a portion of at least one of the first member surface and the second member surface converge toward the other of the first member surface and the second member in the direction of the path and in a direction perpendicular to the path and toward the proximate end of the sheets.

Pursuant to yet another aspect of the present invention, there is provided an electrophotographic printing machine having a stapling device for affixing a set of sheets moving in a direction along a path toward a stapling station. The stapling device includes a housing, a stapler secured to the housing and positioned at the stapling station, and a guide. The guide is secured to the housing. The guide includes a first member having a first member surface thereof and a second member having a second member surface thereof. The guide further defines an aperture between the first member and the second member. The first member surface and the second member surface direct the sheets therebetween through the aperture toward the stapler. At least a portion of at least one of the first member surface and the second member surface converge toward the other of the first member surface and the second member in the direction of the path and in a direction perpendicular to the path and toward the proximate end of the sheets.

Other features of the present invention will become apparent as the following description proceeds and upon reference to the drawings, in which.

Figure 1:
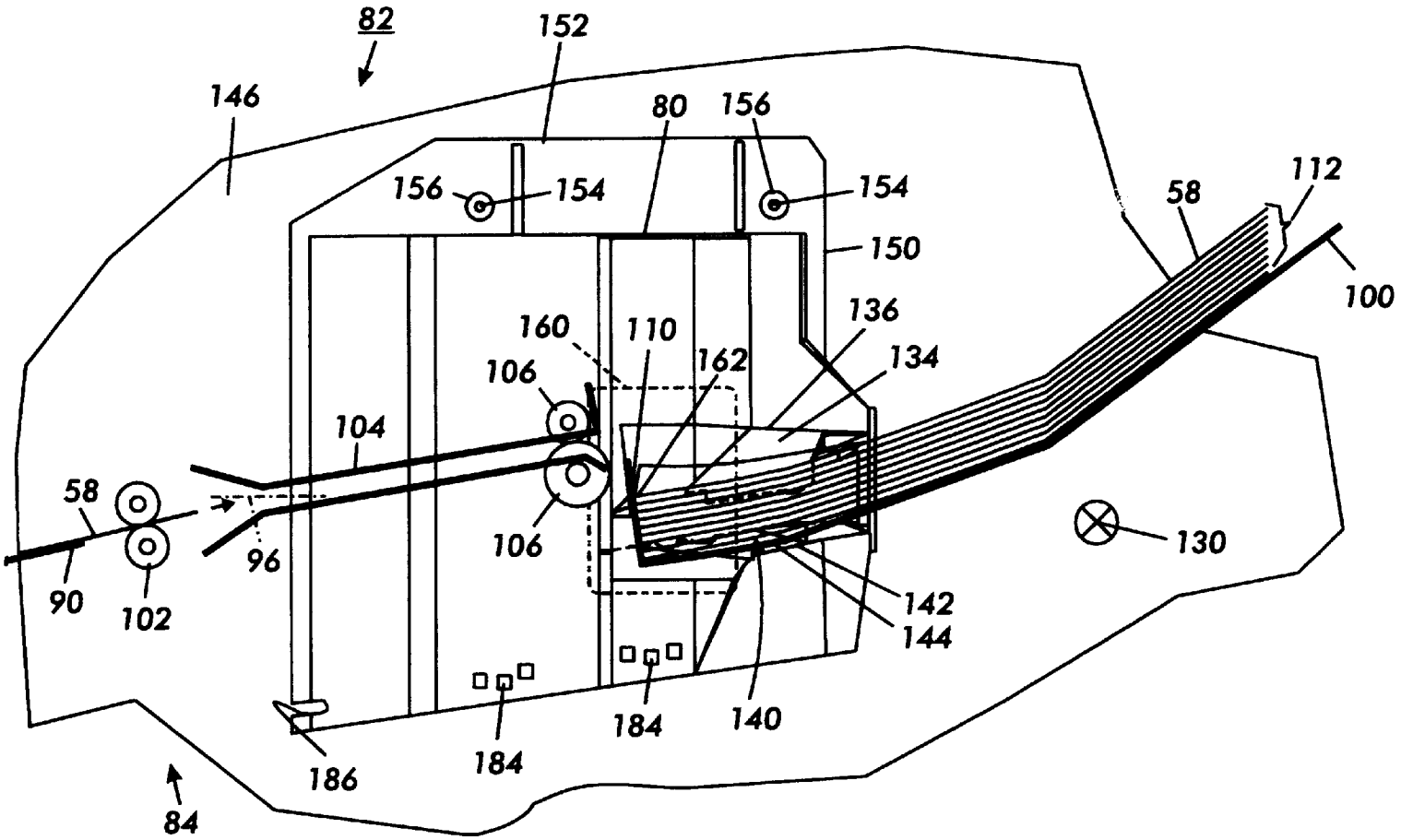
FIG. 1 is a rear elevational view of a stapler throat according to the present invention with a stack of paper with the lead edge in a curl up position.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Figure 8:
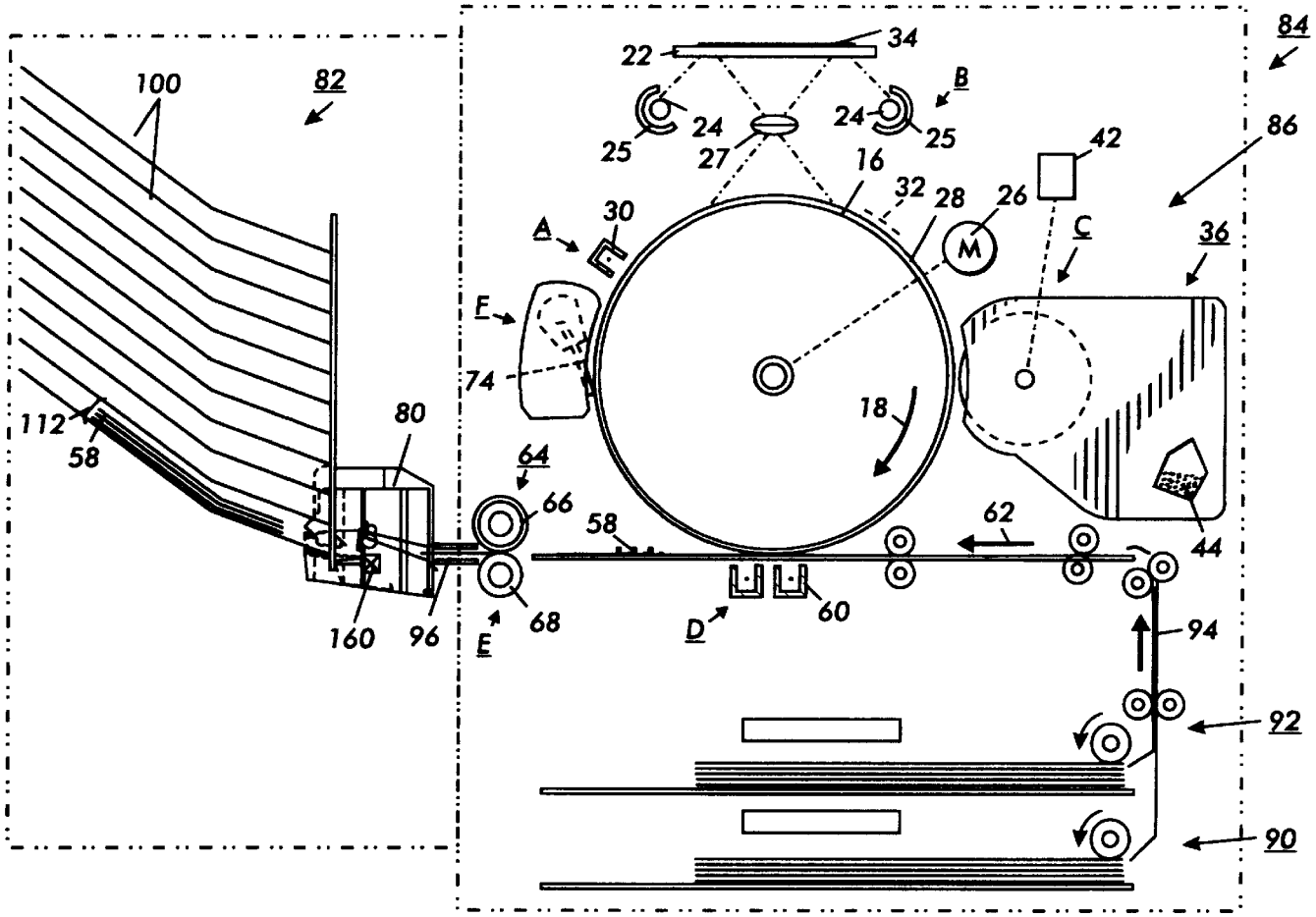
FIG. 8 is a schematic elevational view of an electrophotographic printing machine incorporating the FIG. 1 stapler throat therein.

Referring now to FIG. 8, the electrophotographic printing machine shown employs a photoconductive drum 16, although photo-receptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 26 rotates drum 16 to advance drum 16 in the direction of arrow 18. Drum 16 is coupled to motor 26, by suitable means such as a drive.

Initially successive portions of drum 16 pass through charging station A. At charging station A, a corona generating device, indicated generally by the reference numeral 30, charges the drum 16 to a selectively high uniform electrical potential. The electrical potential is normally opposite in sign to the charge of the toner. Depending on the toner chemical composition, the potential may be positive or negative. Any suitable control, well known in the art, may be employed for controlling the corona generating device 30.

A document 34 to be reproduced is placed on a platen 22, located at imaging station B, where it is illuminated in a known manner by a light source such as a lamp 24 with a photo spectral output matching the photo spectral sensitivity of the photoconductor. The document thus exposed is imaged onto the drum 16 by a system of mirrors 25 and lens 27, as shown. The optical image selectively discharges surface 28 of the drum 16 in an image configuration whereby an electrostatic latent image 32 of the original document is recorded on the drum 16 at the imaging station B.

At development station C, a development system or unit, indicated generally by the reference numeral 36 advances developer materials into contact with the electrostatic latent images. The developer unit includes a device to advance developer material into contact with the latent image.

The developer unit 36, in the direction of movement of drum 16 as indicated by arrow 18, develops the charged image areas of the photoconductive surface. This developer unit contains, for example, black developer material 44 having a triboelectric charge such that the black toner is attracted to charged areas of the latent image by the electrostatic field existing between the photoconductive surface and the electrically biased developer rolls in the developer unit, which are connected to the bias power supply 42, attracts the toner to the latent image.

A sheet of support material 58 is moved into contact with the toner image at transfer station D. The sheet of support material 58 is advanced to transfer station D by conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of drum 16, the residual toner particles carried by image and the non-image areas on the photoconductive surface are removed at cleaning station F. The cleaning station F includes a blade 74.

It is believed that the foregoing description is sufficient for purposes of the present application to illustrate the general operation of an electrophotographic printing machine incorporating the development apparatus of the present invention therein.

According to the present invention and referring again to FIG. 8, a device in the form of a stapler guide or throat 80 is shown as a part of a finisher 82 in the form of a bin type sorter. The sorter 82 is attached to copy machine 84. Copy machine 84 includes a print engine 86, the relevant components thereof being described earlier. Sheets 58 are developed in the copy machine 84 and are fed from lower paper tray 90 and upper paper tray 92 through paper path 94 toward the sheet transfer position 96.

As the sheets 58 pass by fusing station E, the developer material 44 is fused onto the sheet by fuser roll 66. The fusing of the developer material 44 onto the sheets 58 tends to cause the sheets 58 to curl upwardly.

The sheets are transferred past sheet transfer position 96 toward a bin 100. The sheets 58 are collected in the bin 100 prior to stapling.

The sheet guiding device 80 of the present invention is shown in greater detail in FIG. 1. Sheet 58 within the printing machine 84 is fed along paper transport 90 and through sheet exit feed rolls 102. The sheet 58 passes by sheet transfer position 96 as it enters finisher 82. The sheet 58 is guided by sheet baffles 104 located within the finisher 82. The sheet 82 advances toward finisher rolls 106 and is fed by finisher rolls 106 toward bin 100. The sheets 58 are permitted to settle into bin 100 and fall by gravity toward bin stop 110. Successive sheets 58 traverse in a similar fashion to the previously mentioned sheet and rest within bin 100 on top of the first sheet 58. The sheets 58 continue to accumulate into a set 112 of sheets 58 located together in bin 100 ready for stapling.

Figure 3:
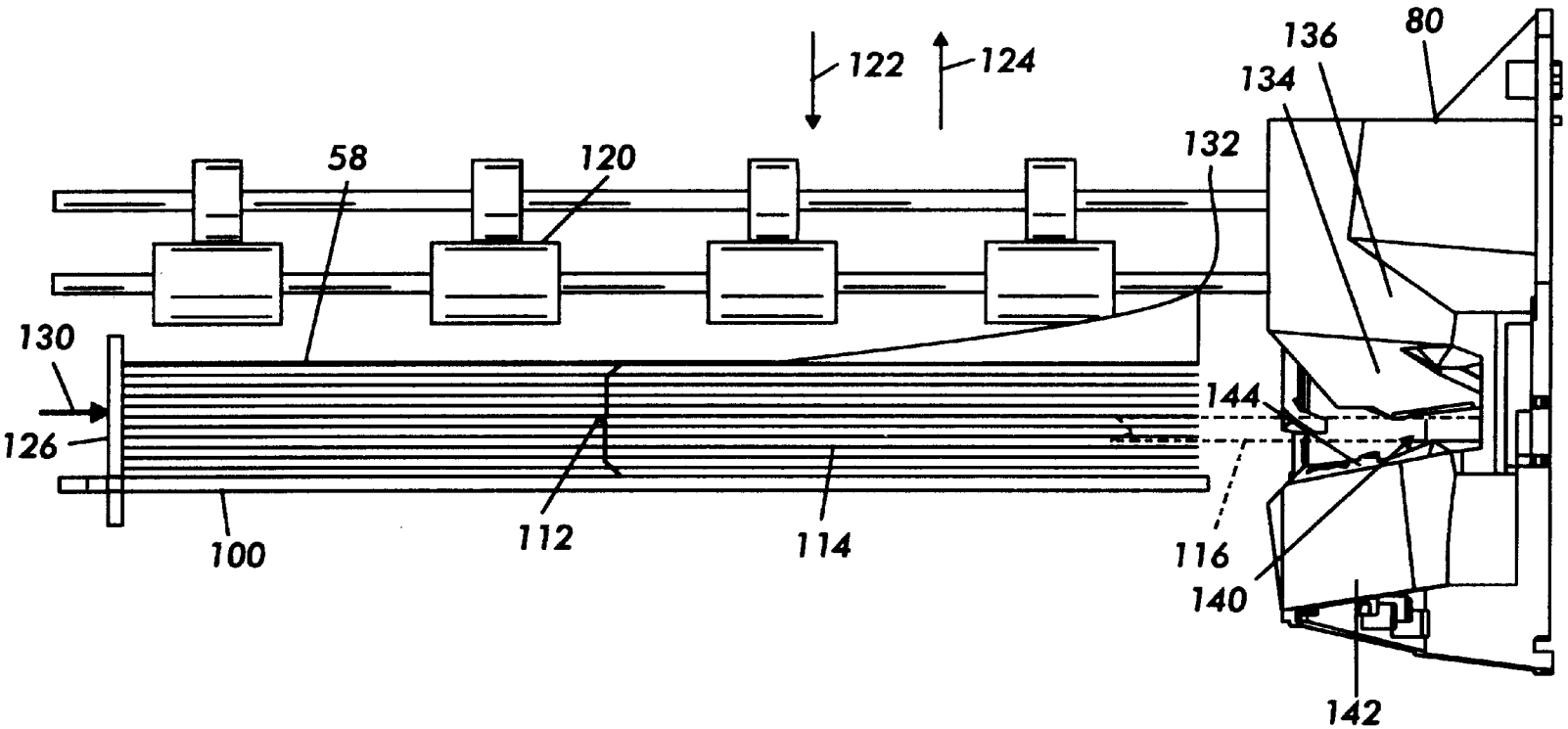
FIG. 3 is an end view of the stapler throat of FIG. 1 with a stack of paper with the lead edge in a curl up position.

Referring now to FIG. 3, the set 112 of sheets 58 is shown in the settled position on bin 100 in staging position 114 awaiting movement into stapling position 116 (shown in phantom).

While the set 112 of sheets 58 is in the staging position 114, a sheet compressor or vertical tamper 120 is advanced downwardly in the direction of arrow 122 toward the set 112 of sheets 58 in order that they be compressed. The compressor 120 after compressing the sheets 58 returns in the direction of arrow 124 into a rest position. After the sheets 58 have been compressed, a edge tamper or tamper 126 advances the sheets in direction of arrow 130 toward stapling position 116. As curled portion 132 of the set 112 of sheets 58 approach the stapler guide 80, the curled portion 132 contacts first member surface 134 of first member 136.

Figure 2:
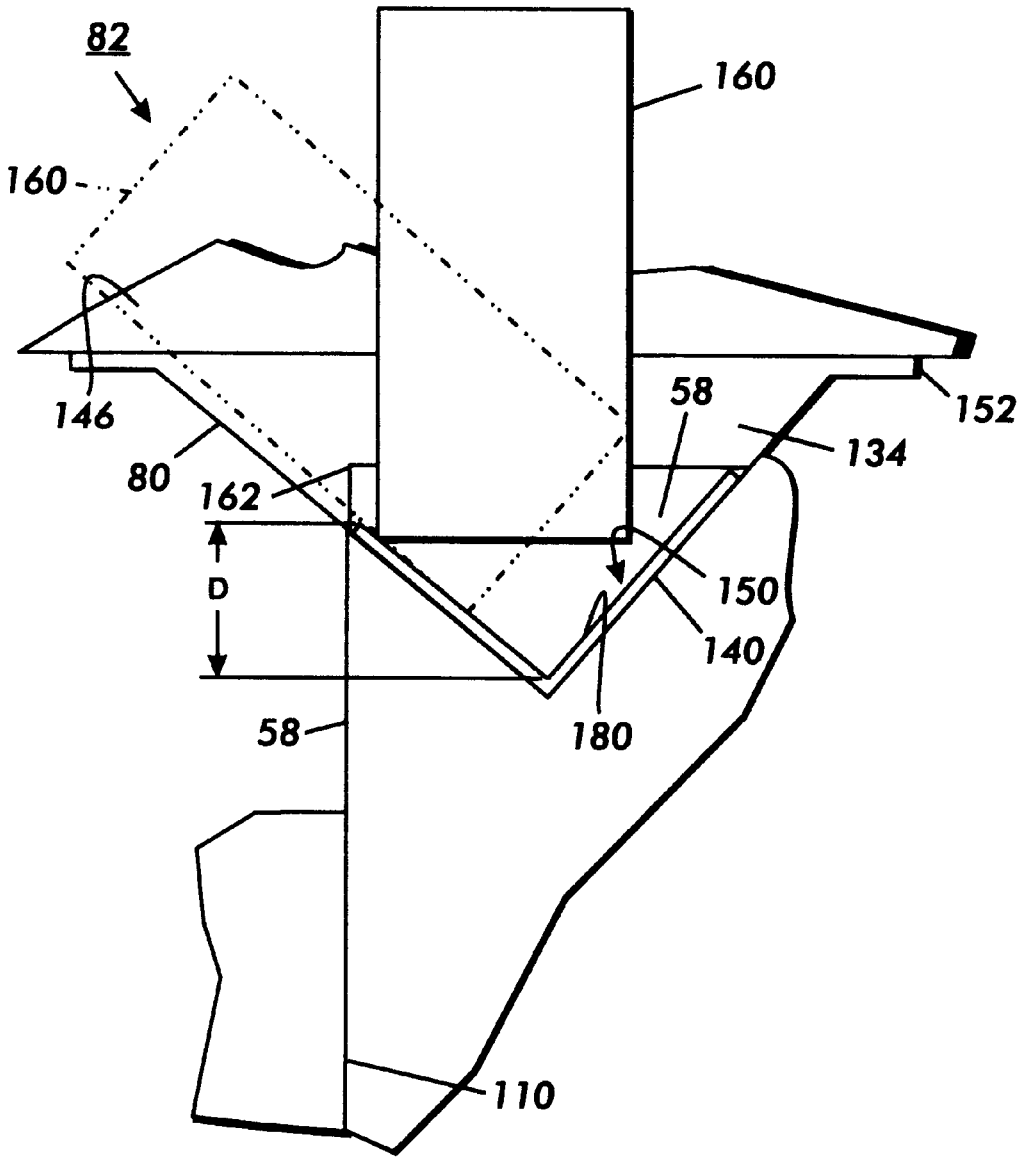
FIG. 2 is a top view of the FIG. 1 stapler throat showing the stapler and copy sheet in operating position.
Figure 4:
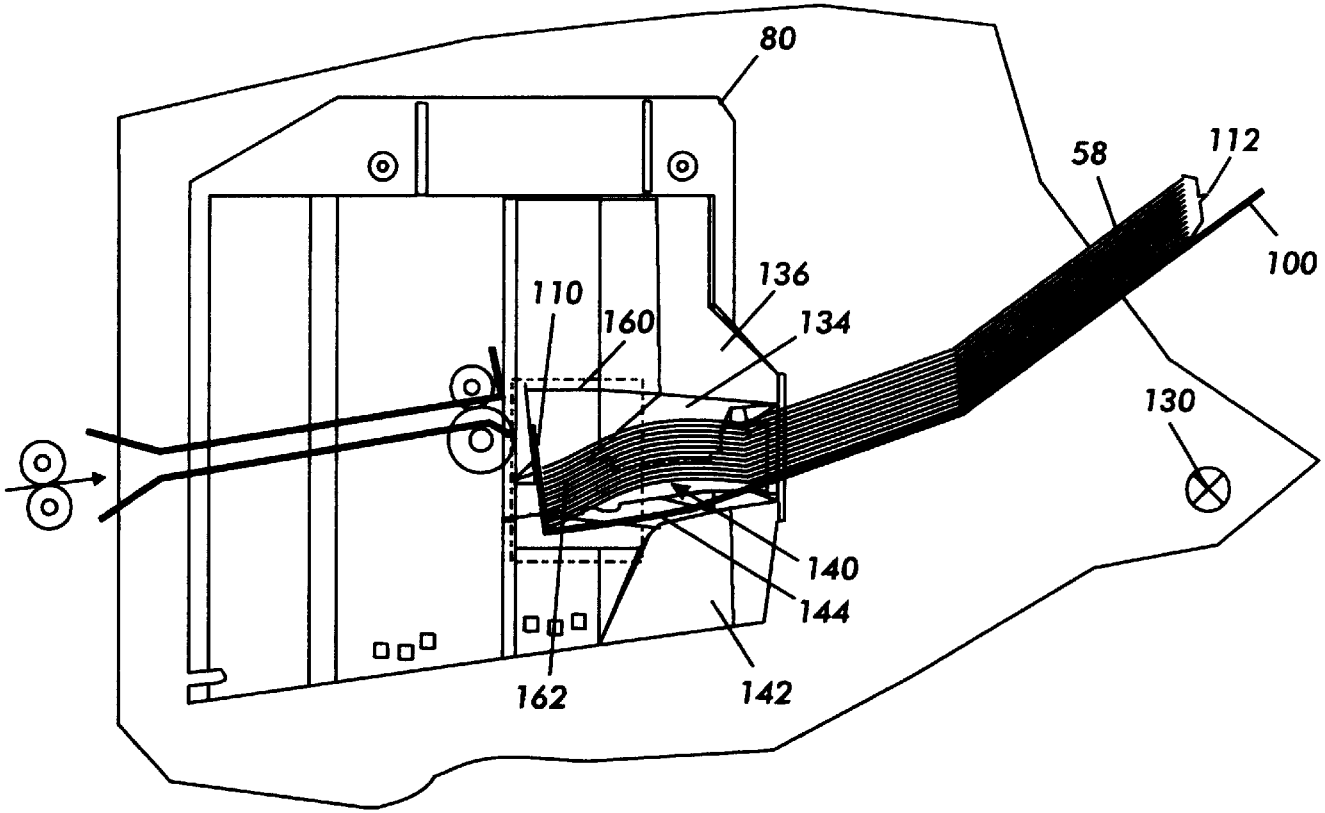
FIG. 4 is a rear elevational view of the stapler throat of FIG. 1 with a stack of paper with the lead edge in a curl down position.
Figure 5:
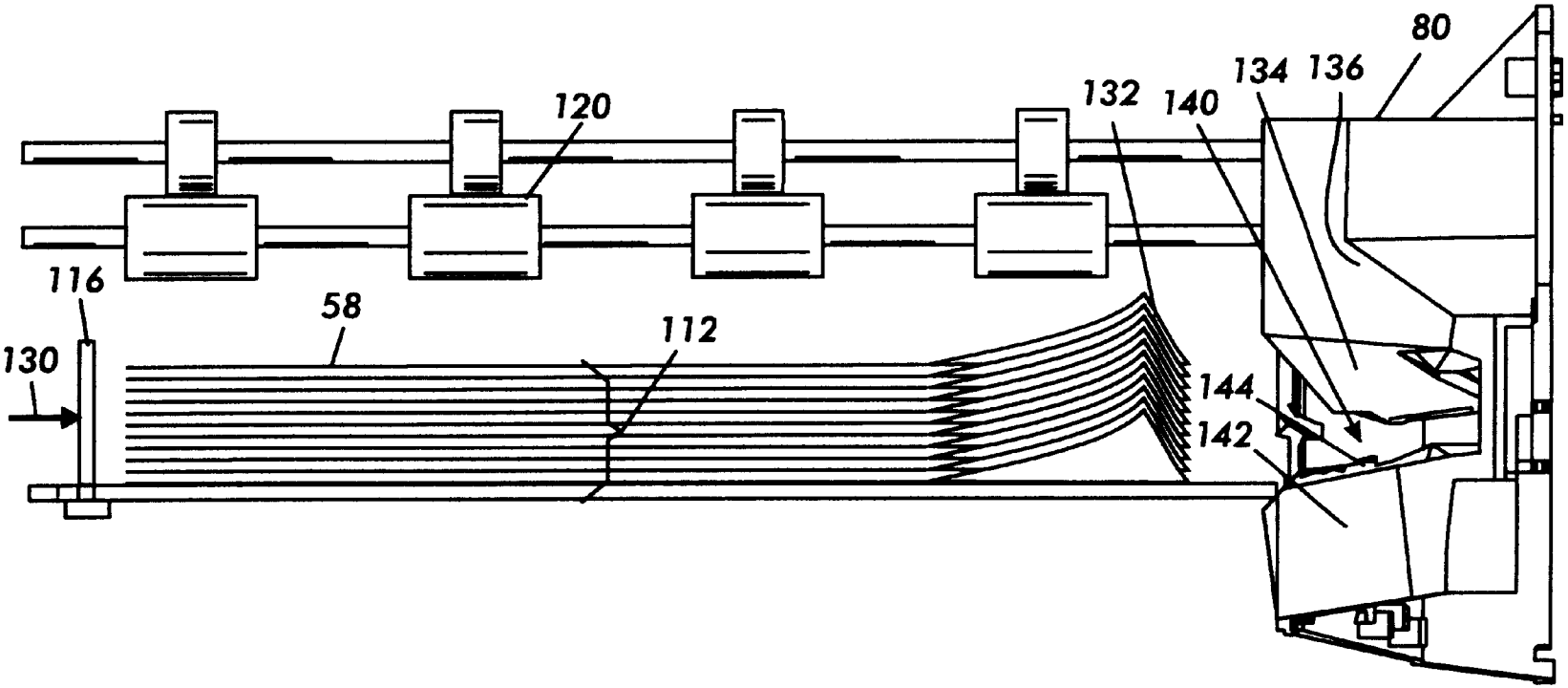
FIG. 5 is an end view of the stapler throat of FIG. 1 with a stack of paper with the lead edge in a curl down position.

The first member surface 134 is positioned at a compound angle to the sheets 58 in order to urge the curled portion 112 of the sheets 58 downwardly into position so that it may pass through opening 140 in the stapler guide 80. As the set 132 of sheets 58 advance further towards stapling position 116, a corner of the set 112 of sheets 58 including a portion of the curled portion 132 of the sheets 58 are urged into opening 140 formed between first member 136 and second member 142 of staple guide 80. The second member 142 includes a second member surface 144. The second member surface 144 contacts the lower portion of the curled portion 132 of the set of sheets 112 and with the first member surface 134 guides the sheets 58 into opening 140. The second member surface 144 may be coplanar with the sheets 58. A coplanar or flat second member surface 144 may be sufficient for both curled up sheets as shown in FIGS. 1 and 3 and for curled down sheets as shown in FIGS. 4 and 5. As shown in FIG. 3, the second member surface may be positioned on a compound angle relative to the sheets 58 to assist in guiding the curled portion 132 into opening 140. The first member 136 and the second member 142 may be separate, distinct members, or, as shown in FIG. 2, be integral with each other and together form the device or staple guide 80. The converging portion of at least one of the first member surface and the second member surface may extend a distance from the corner of the sheets to be stapled from 0.2 inches to 2.0 inches. The converging portion of at least one of the first member surface and the second member surface may be arcuate.

Referring again to FIG. 1, the staple guide is shown mounted to housing 146 of finisher 82. The first member 136 and second member 142 may take on any suitable shape and may be made of any suitable durable material and may be separable items. Preferably, however, the first member 136 and second member 142 are integral with body 150 forming the guide 80. The body 150 may be made of any suitable durable material. For example, from a metal or plastic. The body 150 may, for example, be made of a plastic, e.g. polycarbonate.

The stapling guide 80 may be secured to the housing 146 of the finisher 82 in any suitable manner. For example, the body 150 may include a mounting flange 152 including holes 154 extending through bosses 156. Fasteners 158 (see FIG. 6) may be fitted within the holes 154 and secured to housing 146. Similarly, the staple guide 80 may be welded, glued, or clipped, or secured in any other fashion to the housing 146.

As shown in FIG. 1, a finishing device in the form of a stapler 160 is positioned behind the body 150 so that the staples may be inserted in the stack 112 of sheets 58 while the sheets 58 are fitted within opening 140. The stapler may, as shown in FIG. 2, be configured to staple sheets 58 in a choice of two orientations, namely in a diagonal orientation as shown in phantom lines and in an orientation perpendicular to the bin stop 110 as shown in solid lines. The stapler 160 may be any commercially available stapler such as those available from Gradco, or any other commercial stapler manufacturer.

Referring now to FIG. 1, a stapler 160 is shown in position with stapled corner 162 of sheet 58 extending through opening 140 of staple guide 80. The stapler 160 is positioned behind the staple guide 80 and is likewise mounted to housing 146 of finisher 82.

Referring now to FIG. 4, a set 112 of sheets 58 is shown with the stapled corner 162 of the sheets 58 in a curled down position. While typically because of the fusing process, the corners to be stapled are in a curled up position, it is not highly unlikely for the sheets to be in a curled down position. This can occur from moisture within the sheets, bending of the sheets during the sheet feeding through the printing machine and finisher, or a number of other reasons. When the sheets are in a curled down position, the stapled corner 162 of the sheets 58 contact surface 144 of second member 142 rather than first member surface 134 of first member 136. Since the outer edge of the sheet 58 contacts the bottom of bin 100 while the sheets 58 are being accumulated into a set of sheets, the outer edge is inhibited from curling, making the use of a second member surface 144 co-planar with the bottom of bin 100 feasible.

However, preferably, to assist in accommodating for the curled down position, the second member surface 144 of second member 142 similar to first member surface 134 of first member 136 is oriented in a converging position toward first member surface 134 in the direction of arrow 130 toward the stapler 160. Further, the second member surface 144 converges toward first member surface 134 in the direction of bin stop 110. Thereby, similar to the first member 136, second member 142 urges the stapled corner 162 from a curled down position into the opening 140 of the stapler guide 80 to provide for a quality staple of the set 112 of sheets 58.

Referring now to FIG. 5, the curled portion 132 of the sheets 58 as they advance toward staple guide 80 in the direction of arrow 130, contact second member surface 144 of the second member 142 urging them into the opening 140 to provide for an accurate stapling.

Figure 6:
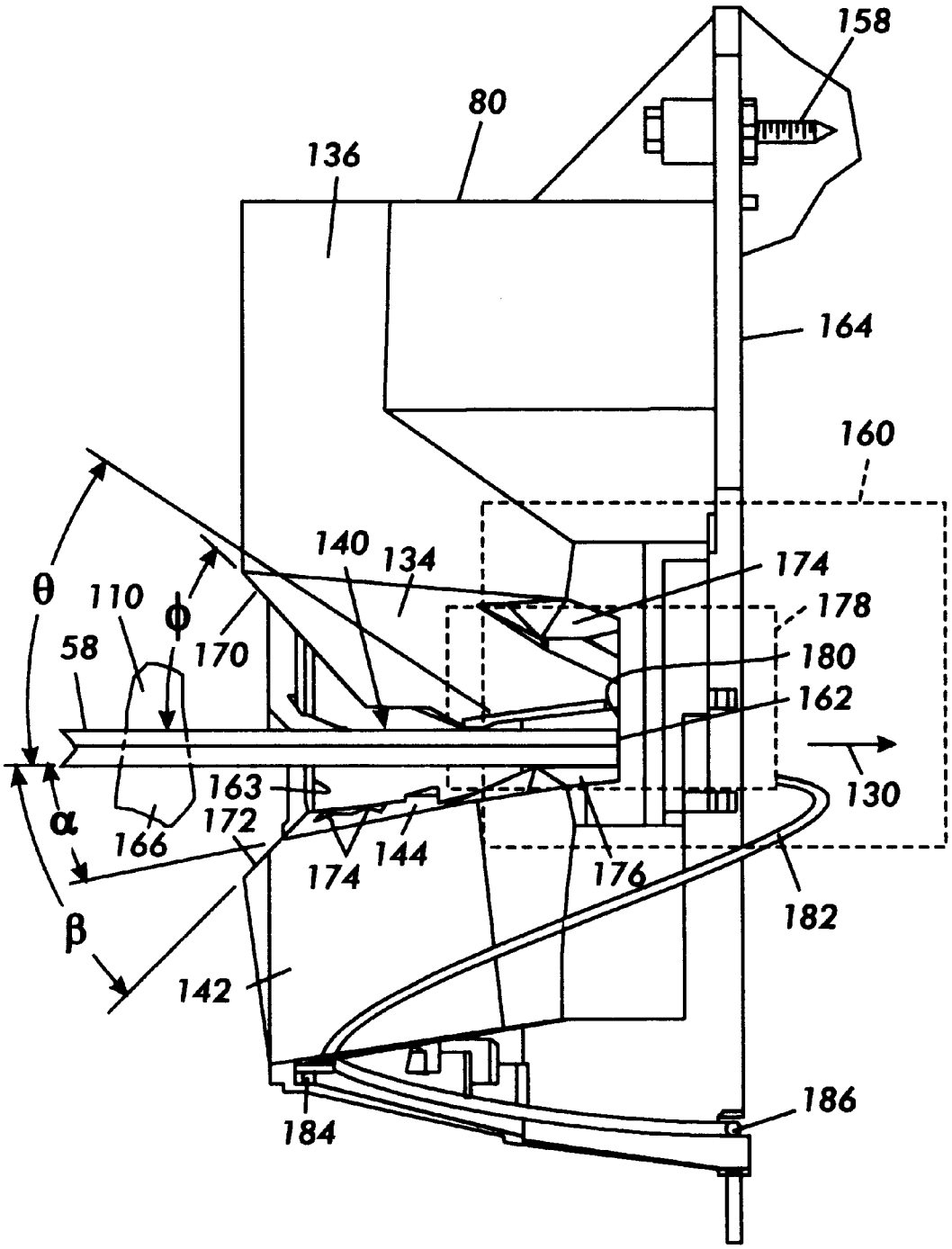
FIG. 6 is an enlarged end view of the stapler throat of FIG. 5.

Referring now to FIG. 6, the staple guide 80 is shown in greater detail. The stapler 160 is positioned at least partially behind staple guide 80. Stapled corner 162 of sheet 58 is fed through opening 140 within the staple guide 80 aligning the sheet portion to be stapled with the stapler 160. The first member surface 134 may take on any suitable configuration and may, as shown in FIG. 6, be planar, but also may be concave or convex with an appropriate radius of curvature. While the invention may be practiced with the first member surface 134 extending substantially the entire stapled corner 162, preferably, as shown in FIGS. 6 and 7, the first member surface 134 is spaced from back periphery 163 of opening 140.

Figure 7:
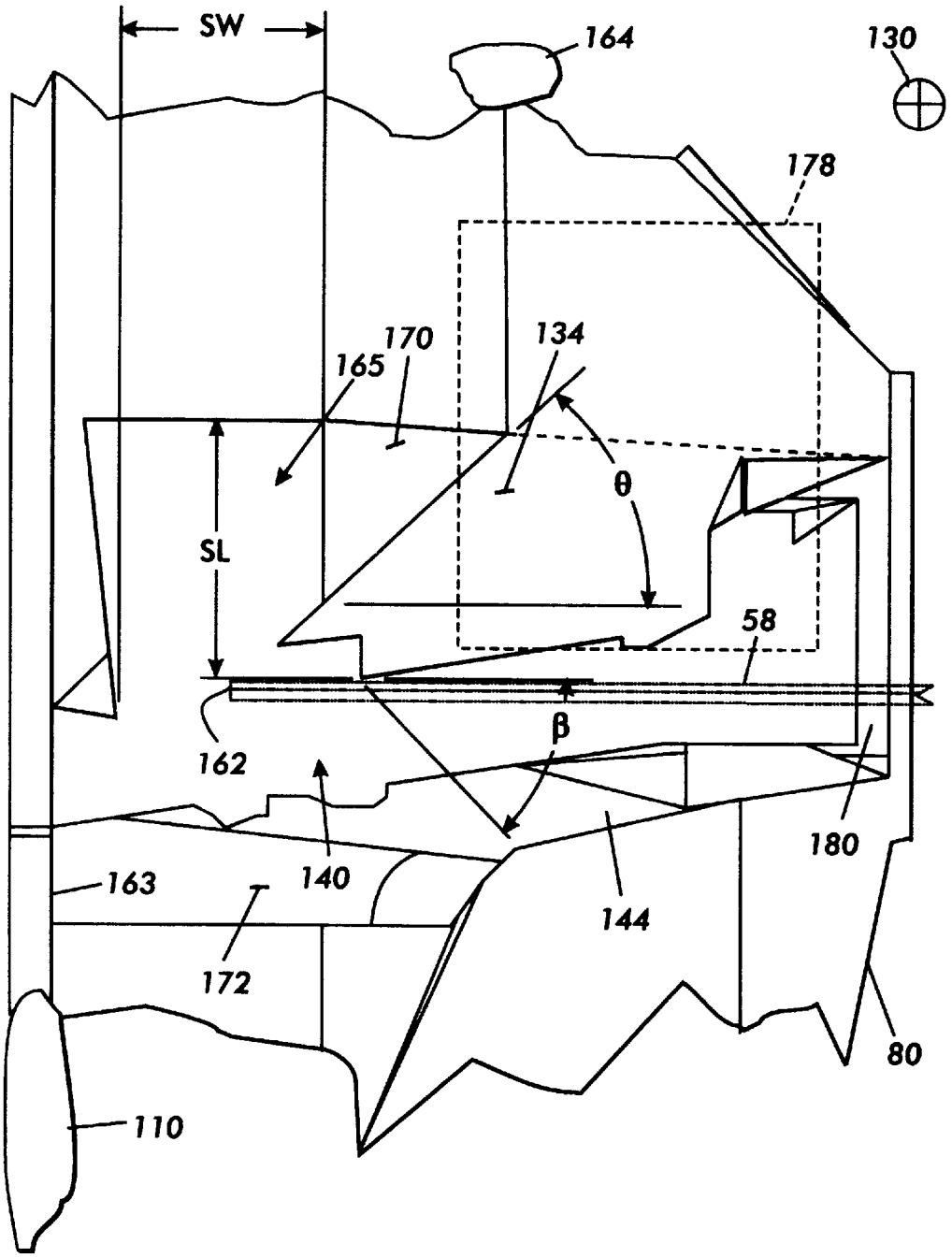
FIG. 7 is a partial enlarged rear elevational view of the stapler throat of FIG. 5.

As shown in FIG. 7, a curl clearance opening 165 is preferably positioned between the first member surface 134 and back periphery 163 of opening 140. The curl clearance opening 165 provides for clearance for extreme paper curl of the stapled corner 162 of the sheets 58. The sheets 58 enter the opening extremely curled and the curl is reduced as the sheets contact the first member surface 134 and are decurled so that the stapled corner 162 may be fitted within the stapler 160.

The curl clearance opening 165 may have any suitable size capable of allowing curled sheets to pass thereby. For example the opening 165 may have a width SW of approximately 0.2 to 1.5 inches with 0.60 inches preferred and a length SL of approximately 0.2 to 1.5 inches with 0.70 inches preferred.

Referring again to FIG. 6, the first member surface 134 may be positioned at any compound angle with respect to sheet 58 sufficient uncurl a curled sheet. Preferably, however, the first member surface 134 is defined by a compound angle including a angle $\theta$ defined by a plane parallel to the bin stop 110 and the sheet 58. The angle $\phi$ can be any angle from 10 degrees to 80 degrees with 45 degrees being preferred.

Further, now referring to FIG. 7, the first member surface 134 can be further defined by a plane parallel to guard mounting surface 164 cutting through the second member surface 136 having an angle $\phi$ with respect to the sheet 58. The angles $\theta$ and $\phi$ combine to define the position of the first member surface 134. The angle $\phi$ can be any angle from 10 degrees to 80 degrees with 45 degrees being preferred.

Referring again to FIG. 6, similar to the first member surface 134, the second member surface 144 may be either concave or convex with appropriate radius of curvature, but preferably the second member surface 144 is planar. The second member surface may have a compound angle with respect to the sheet 58 such that a curled sheet will be uncurled when passing by the staple guide 80. Preferably, however, the second member surface 144 is defined by a slice of the second member surface 144 cut by a plane parallel to bin stop 110 passing through the second member surface 144. Angle $\alpha$ has a dimension of between 10 degrees to 80 degrees with 25 degrees being preferred.

Referring again to FIG. 7, the second member surface 144 is further defined by a plane passing through the second member surface 144 parallel to guard mounting surface 164 and the sheet 58 forming angle $\beta$. Angle $\beta$ defines an angle of from 10 degrees to 80 degrees with 20 degrees being preferred.

To provide clearance for the stapler 160, the first member 134 may, as shown in FIGS. 6 and 7, include a first member chamfer 170 extending from the first member 134 in a direction opposed to the arrow 130. The first member chamfer 170 serves to provide clearance for the mounting of the stapler 160 to the guide 80. The first member chamfer 170 has an angle $\pi$ of approximately 45 degrees with respect to the sheet 58.

Similarly, the second member 142 further includes a second member chamfer 172 extending outwardly in a direction opposed to arrow 130 from second member surface 144. The second member lead in chamfer 172 provides for a guide for sheets that may be misaligned vertically with respect to the guide 80 due to indexing errors in the indexing up and down of the bins 100 to align each of the respective bins 100 with the sheet transfer position 96 (see FIG. 8). The second member lead in chamfer 172 is defined by angle $\chi$ between the chamfer 172 and sheet 58.

Referring again to FIG. 6, the second member 142 preferably also includes staple grooves 174 located in second member surface 144 to accommodate the staples that may not be properly clinched as they are removed with the sheet 58 from the stapler 160.

The first member may also optionally include auxiliary protrusion 174 extending inwardly in the direction of arrow 130 from first member surface 134. Likewise, the second member 142 may include a second member include protrusion 176 extending inwardly from the second member surface 144 in the direction of arrow 130. The protrusions 174 and 176 serve to assist in positioning a sheet sensor 178. The sheet sensor is used to assure that the sheets have been completely registered against sheet end stop 180 on guide 80. The sensor 178 is electrically connected to a power source (not shown) by an electrical conduit 182 secured to guide 80 by clips 184 and passes through guide 80 at slot 186 in guide 80.

Referring to FIG. 2, the stapler 160 is shown in position with respect to the stapler guide 80. While the staple guide 80 may have any suitable dimension with respect to the stapler 80, preferably, distal edges 180 of the first member surface 134 is positioned a distance D from the stapling location of the stapler. The dimension D may be any suitable dimension from 0.3 inches to 2.5 inches with a minimum dimension of 1.0 inches being preferred.

By providing a stapler guide with compound lead in angles, a safe, inexpensive, effective, durable and reliable stapler guide can be provided.

By providing a stapler guide with fixed compound lead in angles, a simple, reliable leading edge decurler can be provided that accommodates a variety of curls including upcurls and downcurls.

By providing a fixed stapler guide with compound lead in angles, a stapler guide can be provided which requires no adjustments.

By providing a stapler guide with compound lead in upper guide, sheets with upcurl can be decurled.

By providing a stapler guide with a lower compound angle lead in guide, a stapler guide can be provided to decurl copy sheets with bottom curl.

It is, therefore, apparent that there has been provided in accordance with the present invention, a lead edge paper guide that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A device for guiding a plurality of sheets moving in a direction along a path toward a finishing device attachable to a printing machine comprising:

a first member having a first member surface thereof; and a second member having a second member surface thereof, said first member surface and said second member surface defining a guide for directing the sheets therebetween in the path toward the finishing device, at least a portion of at least one of said first member surface and said second member surface converging toward the other wherein the direction of the converging of at least one of said first member surface and said second member surface includes at least: (a) a direction of the path toward the finishing device; (b) a direction perpendicular to the path; and (c) a direction toward the proximate end of the sheets.

2. The device according to claim 1, wherein said first member surface and said second member surface each converge toward each other.

3. The device according to claim 1, wherein said first member and said second member are integral with each other.

4. The device according to claim 1, wherein one of said first member surface and said second member surface is parallel with the path.

5. The device according to claim 1, wherein the converging portion of at least one of said first member surface and said second member surface is planar.

6. The device according to claim 1, wherein the converging portion of at least one of said first member surface and said second member surface is arcuate.

7. The device according to claim 1:

wherein the finishing device comprises a stapler for stapling the sheets into a set of sheets, the stapling being performed near a corner of the sheets; and wherein the converging portion of at least one of said first member surface and said second member surface is adjacent the portion of the sheets where the stapling is performed.

8. The device according to claim 7, wherein the converging portion of at least one of said first member surface and said second member surface extends a distance from the corner of the sheets to be stapled of from 0.2 inches to 2.0 inches.

9. A stapling device for affixing a set of sheets moving in a direction along a path toward a stapling station, said stapling device comprising:

a housing;

a stapler secured to said housing and positioned at the stapling station; and a guide secured to said housing, said guide having a first member having a first member surface thereof and a second member having a second member surface thereof, said guide further defining an aperture between said first member and said second member, said first member surface and said second member surface directing the sheets therebetween through the aperture toward the stapler, at least a portion of at least one of said first member surface and said second member surface converging toward the other in the direction of the path, in a direction perpendicular to the paths and in a direction toward the proximate end of the sheets.

10. The stapling device according to claim 9, wherein said first member surface and said second member surface each converge toward each other.

11. The stapling device according to claim 9 wherein said first member and said second member are integral with each other.

12. The stapling device according to claim 9, wherein one of said first member surface and said second member surface is parallel with the path.

13. The stapling device according to claim 9, wherein the converging portion of at least one of said first member surface and said second member surface is planar.

14. The stapling device according to claim 9, wherein the converging portion of at least one of said first member surface and said second member surface is arcuate.

15. The stapling device according to claim 9:

wherein the stapling is performed near a corner of the sheets; and wherein the converging portion of at least one of said first member surface and said second member surface is adjacent the portion of the sheets where the stapling is performed.

16. The stapling device according to claim 15, wherein the converging portion of at least one of said first member surface and said second member surface extends a distance from the corner of the sheets as the sheet passes the device of from 0.5 inches to 2.0 inches.

17. An electrophotographic printing machine having a stapling device for affixing a set of sheets moving in a direction along a path toward a stapling station, said stapling device comprising:

a housing;

a stapler secured to said housing and positioned at the stapling station; and a guide secured to said housing, said guide having a first member having a first member surface thereof and a second member having a second member surface thereof, said guide further defining an aperture between said first member and said second member, said first member surface and said second member surface directing the sheets therebetween through the aperture toward the stapler, at least a portion of at least one of said first member surface and said second member surface converging toward the other in the direction of the paths in a direction perpendicular to the path, and in a direction toward the proximate end of the sheets.

18. The printing machine according to claim 17, wherein said first member surface and said second member surface each converge toward each other.

19. The printing machine according to claim 17 wherein said first member and said second member are integral with each other.

20. The printing machine according to claim 17, wherein one of said first member surface and said second member surface is parallel with the path.

21. The printing machine according to claim 17, wherein the converging portion of at least one of said first member surface and said second member surface is planar.

22. The printing machine according to claim 17, wherein the converging portion of at least one of said first member surface and said second member surface is arcuate.

23. The printing machine according to claim 17:

wherein the stapling is performed near a corner of the sheets; and wherein the converging portion of at least one of said first member surface and said second member surface is adjacent the portion of the sheets where the stapling is performed.

24. The printing machine according to claim 23, wherein the converging portion of at least one of said first member surface and said second member surface extends a distance from the corner of the sheets as the sheet passes the device of from 0.5 inches to 2.0 inches.

* * * * *